United States Patent [19]

Huntress

[11] 3,951,319

[45] Apr. 20, 1976

[54] ZIPPER PULLER (ZIPPER ZIP)

[75] Inventor: Inez A. Huntress, Glendale, Calif.

[73] Assignee: The Raymond Lee Organization, Inc., New York, N.Y. ; a part interest

[22] Filed: Mar. 17, 1975

[21] Appl. No.: 558,725

[52] U.S. Cl. ..... 223/111; 24/205.15 H; 294/1 A

[51] Int. Cl.[2] ..... A47J 51/06

[58] Field of Search ..... 223/111; 294/1 A; 24/205.15 H

[56] References Cited

UNITED STATES PATENTS

| | | | |
|---|---|---|---|
| 490,806 | 1/1893 | Gulick | 24/205.15 H |
| 2,604,242 | 7/1952 | Vahan | 223/111 |
| 2,939,193 | 6/1960 | Morgan | 294/1 A |
| 3,199,753 | 8/1965 | Robertson et al. | 223/111 X |
| 3,201,839 | 8/1965 | Reifsteck et al. | 294/1 A |
| 3,568,901 | 3/1971 | McNitt | 223/111 |

*Primary Examiner*—George H. Krizmanich
*Attorney, Agent, or Firm*—Howard I. Podell

[57] ABSTRACT

A flexible chain fastened at one end to a wall of a fitting or dressing room, fitted at its opposed free end with a hook of a size to fasten to the hole of the pull tab of a zipper assembly of a garment. In use, the hook is fastened by a user to the pull tab of a zipper assembly of a garment worn by the user and the length of chain is freely wrapped about a hand or wrist of the user to enable the user to close or open the zipper assembly of the garment she is wearing.

1 Claim, 3 Drawing Figures

ZIPPER PULLER (ZIPPER ZIP)

SUMMARY OF THE INVENTION

My invention is a flexible chain fastened at one end to a wall of a fitting or dressing room, fitted at its opposed free end with a hook of a size to fasten to the hole of the pull tab of a zipper assembly of a garment. In use, the hook is fastened by a user to the pull tab of a zipper assembly of a garment worn by the user and the length of chain is freely wrapped about a hand or wrist of the user to enable the user to close or open the zipper assembly of the garment she is wearing.

The use of my invention in fitting rooms and dressing rooms eliminates the need for assistance from an attendant in closing or opening a zipper assembly mounted on the rear of a worn garment.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
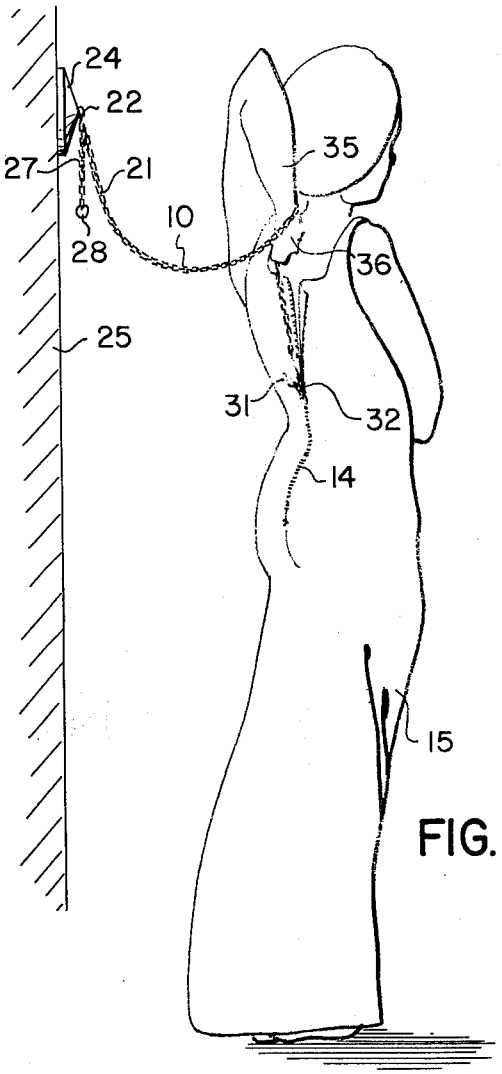
FIG. 1 illustrates the invention in use.

Turning now descriptively to the drawings, in which similar reference characters denote similar elements throughout the several views, FIG. 1 illustrates a woman 11 employing the invention 10 to close a zipper assembly 14 mounted at the rear of a dress 15 she is wearing.

Figure 2:
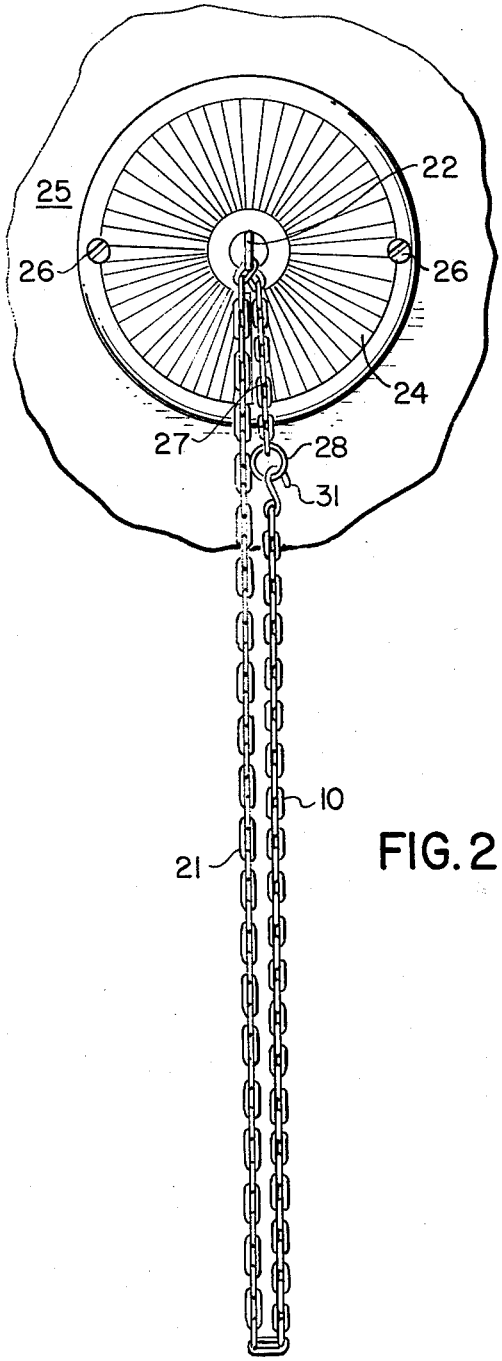
FIG. 2 is an elevation view of the invention.
Figure 3:
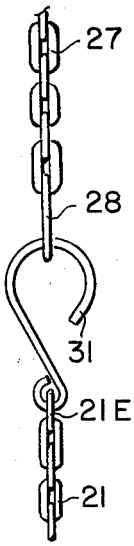
FIG. 3 is a fragmentary elevation view of the invention.

As shown in FIGS. 1-3, the invention 10 is in the form of a length of flexible chain 21 fastened at one end to a closed loop 22 projecting from a circular plate 24 fastened to a wall 25 by screws 26. A short additional length of chain 27 terminating in a closed loop 28 is also hung from the loop 22 of the wall plate 24. The free end 21E of chain 21 is fitted with an open hook 31 of a size to fit into the hole of a zipper slide tab 32 or alternately into the loop 28 of chain 27. Chain 21 is of a length to permit fastening to a zipper tab 32 mounted on the rear of a worn garment with a section of chain 21 wrapped about a wrist 35 or hand 36 of the user.

Wall plate 24 is preferably mounted at a height on wall 25 to permit ease in grasping hook 31 when fastening or unfastening hook 31 to or from loop 28 of chain 27. Chains 21 and 27 may be alternately fabricated of flexible cable, string or wire.

Since obvious changes may be made in the specific embodiment of the invention described herein, such modifications being within the spirit and scope of the invention claimed, it is indicated that all matter contained herein is intended as illustrative and not as limiting in scope.

Having thus described my invention, what I claim as new and desire to secure by Letters Patent of the United States is:

1. A device to permit a person to operate a zipper slide located in a relatively inaccessible location on a garment worn by the person comprising a plate member adapted to be mounted to a fixed vertical surface of a dressing room, said plate fitted with a closed loop projecting from the plate, a first length of flexible material fastened at one end to the closed loop, and fastened at the other end to an open hook of a size to fit the hole of a zipper slider tab, and a second length of flexible material fastened at one end to the closed loop and fastened at the other end to an open ring of a size to readily engage the hook of the said first length, said second length of flexible material being of a shorter length than the said first length so as to serve as a means of supporting the hook of the first length, when not in use, in a uniform location accessible to a person in the dressing room who wishes to detach the hook of the said first length from the ring of the second length and engage the hook into the slider tab of a zipper so as to operate the zipper slider by pulling on the said first length against the engaged hook, said plate adapted to be located on a vertical surface of a dressing room at a height above the dressing room floor so that a ring of a said second length is freely suspended at a height readily accessible to a user of a dressing room.

* * * * *